US006409524B1

(12) United States Patent
Miller et al.

(10) Patent No.: US 6,409,524 B1
(45) Date of Patent: Jun. 25, 2002

(54) SIDE-MOUNTED TRACKLIGHT SYSTEM

(76) Inventors: Jack V. Miller; Ruth E. Miller, both of 20961 Sussex Hwy. 13, Seaford, DE (US) 19973

( * ) Notice: Subject to any disclaimer, the term of this patent is extended or adjusted under 35 U.S.C. 154(b) by 0 days.

(21) Appl. No.: 09/917,516

(22) Filed: Jul. 30, 2001

(51) Int. Cl.[7] ..... H01R 25/00
(52) U.S. Cl. ..... 439/110
(58) Field of Search ..... 439/110, 94, 121, 439/716, 532, 111–112, 116–120

(56) References Cited

U.S. PATENT DOCUMENTS 3,753,209 A * 8/1973 Hesse ..... 439/110
3,963,294 A * 6/1976 Heritage ..... 439/110
4,243,284 A * 1/1981 Humphreys ..... 439/110
4,749,358 A * 6/1988 Soleanski ..... 439/119
4,812,134 A * 3/1989 Miller et al. ..... 439/110
6,290,516 B1 * 9/2001 Gerber ..... 439/110
6,325,645 B1 * 12/2001 Schuite ..... 439/110

* cited by examiner

*Primary Examiner*—Gary Paumen
*Assistant Examiner*—Felix O. Figueroa

(57) ABSTRACT

A tracklight system includes a generally U-shaped track comprising an elongated metal extrusion having a canted base extending between a first parallel leg extending at an acute angle from the base to a distal end and a second parallel leg extending at an obtuse angle from the base to a distal end. The first parallel leg has means for attaching it to a wall or ceiling, and an elongated insulator is attached to second parallel leg 26 and extending through the track length. The insulator has a number of longitudinal slots, each including an electrical conductor receiving power from remote mains. One or more tracklight fixtures may be mounted onto or within the parallel legs.

In a preferred embodiment the distal end of the first parallel leg terminates in a J-shaped hook suitable for hanging paintings, or other wall hangings, to be illuminated by the fixtures of the track.

4 Claims, 3 Drawing Sheets

20
70
34
71
46

34
36
70
20
71

46
71
70
20
34

65
60
44
35
34
64
61
66
63
46
62

SIDE-MOUNTED TRACKLIGHT SYSTEM

BACKGROUND

1. Field of The Invention

This invention relates to the field of tracklight systems with light fixtures positionable in an elongated U-shaped track. Depending track fixtures are attached to an extruded aluminum track having internal insulated conductors therethrough, held in grooves of insulators extending through the length of the track and connected to external power mains. Fixture adapters mechanically and electrically connect the fixtures to the track and the electrical conductors.

2. Description of Prior Art

Prior art tracklights are normally mounted to a ceiling with screws through drilled holes in the base of a U-shaped track, with the legs of the U depending downwards. The base of the track may optionally be mounted to a wall with the legs extending horizontally outwards.

A basic disadvantage of the above described prior-art tracklight systems is that the depending legs have insulators and conductors on both of their inward-facing surfaces, precluding drilling holes to screw a depending leg to a ceiling or wall. Thus a ceiling installation is limited to attachment through the horizontal base of the U shape of the track.

There are few examples of prior art tracklights specifically for wall mounting. One such example is the Wall Mounted Lighting Track System shown in the appliants' U.S. Pat. No. 4,812,134 which has its insulator and conductors across the base of a U-shaped track. Although this prior-art track may be fastened to a wall, it has the disadvantage of other prior-art tracklights in ceiling-mounted use, wherein the fixtures, mounted on depending trunnions, extend downward into the room, making the ceiling appear lower, more cluttered and often within reach of the occupants who may damage the fixtures or be injured by touching the fixtures.

OBJECTS OF THE PRESENT INVENTION

The principal object of the present invention is to provide a tracklight system that may be mounted to a ceiling or wall by on-site by drilling or factory pre-drilling one of the depending legs and installing the track with screws into either a ceiling or wall. Another object of the invention is to provide a track system that when attached to a ceiling, emits light substantially parallel to the ceiling. This will permit the track fixures to operate as wall washers, to illuminate objects on walls or on shelves on or near walls. Yet another object of the invention is to provide a track system that is attachable to a ceiling with the fixture and trunnion extending horizontally from the track instead of vertically depending, whereby the fixtures are closer to the ceiling and further from the reach of occupants. Still another object of the invention is to provide a track system that is attachable to a wall, wherein the emitted light is substantially directed parallel to the wall as either a soffit downlight or a cove uplight.

BRIEF DESCRIPTION AND ADVANTAGES OF THE PRESENT INVENTION

The objects of the present invention are achieved by a tracklight system including an elongated metallic track generally in the shape of a U, having a base and first and second parallel depending legs with proximal ends contiguous with the base of the U and having distal ends terminating in a common plane perpendicular to the legs. A single elongated insulator, including electrical conductors, is attached to only the first depending leg, and the second depending leg is provided with an inward-facing rib that permits an installer in the fireld to drill mounting screw holes through one leg of track and into the ceiling structure.

The advantages of the present invention of a track system are the ability to attach the track to a ceiling through one leg, whereby the open side of the U-shaped track is horizontal, not vertical. Thus the light may be aimed parallel to the ceiling, used as a wall washer, or may be used to illuminate objects on walls or on shelves on or near walls. Yet another advantage of the invention is a track system that is attachable to a ceiling with the fixture and trunnion extending horizontally from the track, closer to the ceiling and further from the reach of occupants. Still another advantage of the invention is a track system that is attachable to a wall as a soffit downlight or a cove uplight

DETAILED DESCRIPTION OF THE DRAWINGS

Figure 1:
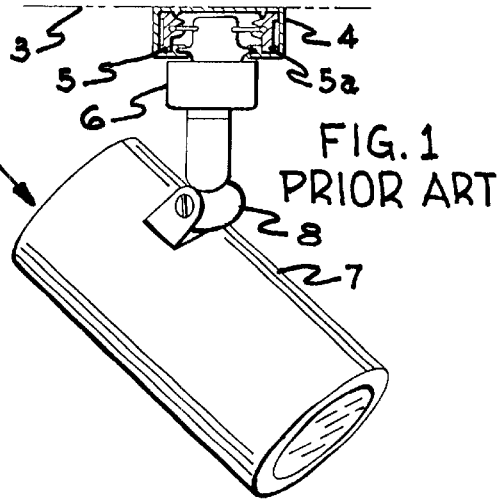
FIG. 1 PRIOR ART
FIG. 1 is a partial transverse cross-sectional view of a typical prior-art ceiling-mounted incandescent tracklight.

In FIG. 1 a partial transverse cross-sectional view of a typical prior-art incandescent tracklight 1 attached to a ceiling 2 shows a generally "C" shaped metal track extrusion 4 enclosing a pair of conductor-carrying insulators 5, 5*a* connected to external power mains which are not shown. A fixture adapter 6 supports and connects a typical incandescent luminaire 7 on an aimable trunnion 8, whereby the trunnion and luminaire may extend down into a room.

Figure 2:
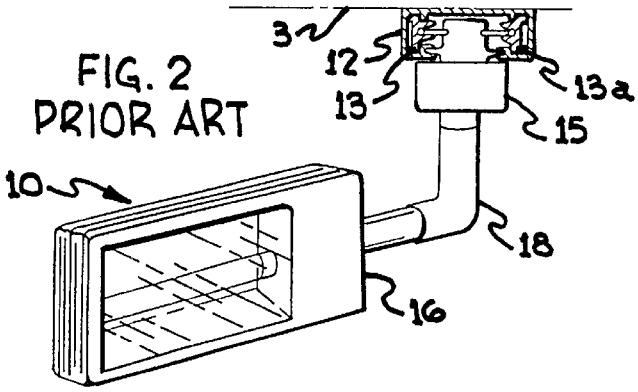
FIG. 2 PRIOR ART
FIG. 2 is a partial transverse cross-sectional view of a typical prior-art ceiling-mounted fluorescent tracklight.

In FIG. 2 a partial transverse cross-sectional view of a typical prior-art fluorescent tracklight 9 shows a generally "C" shaped metal track extrusion 4 attached to a ceiling 2 and enclosing a pair of conductor- carrying insulators 5, 5*a* connected to external power mains which are not shown. A fixture adapter 6 supports and connects a typical fluorescent luminaire 10 on an aimable trunnion 11.

Figure 3:
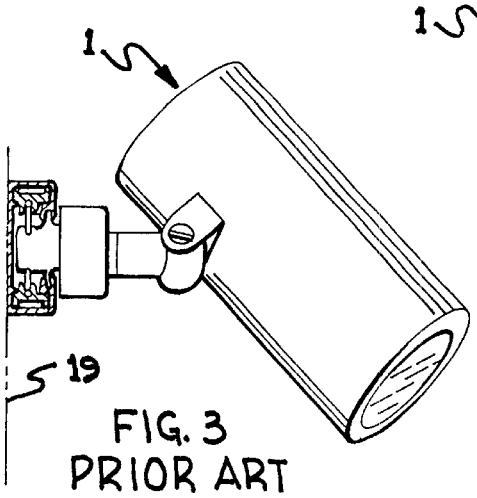
FIG. 3 PRIOR ART
FIG. 3 is a partial transverse cross-sectional view of a prior-art wall-mounted incandescent tracklight.

In FIG. 3 a prior-art incandescent tracklight 12 is shown having a generally C-shaped track 13 having a depending leg with an upturned lip 19. Track 13 is mounted to a wall 3 with screws, not shown, and extends horizontally into a room. A fixture adapter 14 including a trunnion 15 supports and connects an incandescent fixture 16 to a slotted insulator 17 holding conductors 18.

Figure 4:
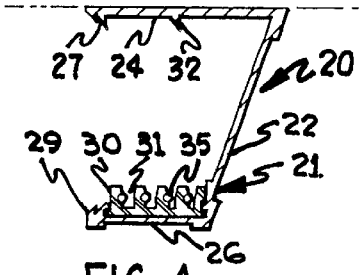
FIG. 4 is a transverse cross-sectional view of a track according to the present invention.

In FIG. 4 a transverse cross-sectional view of a track 20 according to the present includes a generally U-shaped metal extrusion 21. The U-shaped extrusion 21 has a canted base 22 extending between a first parallel leg 24 and a second parallel leg 26. Parallel leg 24 extends at an acute angle from base 22 to a distal end 27 and parallel leg 26 extends at an obtuse angle from base 22 to a distal end 29. Leg 24 includes an inward-facing rib 32 approximately at its mid-point between the base and distal end 27. An elongated insulator 30, extending through the track 20 length, is attached to leg 26, each insulator having a number of longitudinal slots 31, each including an electrical conductor 35 receiving power from remote mains, not shown.

Figure 5:
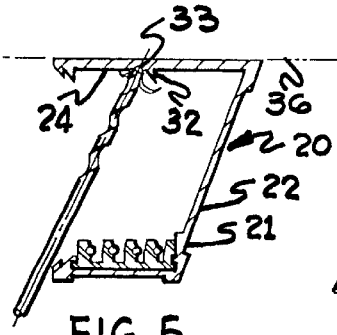
FIG. 5 is a transverse cross-sectional view of a track according to the present invention being drilled for installation.

In FIG. 5 track 20 is shown being drilled against rib 32 for installation on a ceiling 2. Rib 32 provides a means for preventing drill bit from sliding towards base 22 of extrusion 21, so the drilled hole 33 will penetrate leg 24 at about its mid-point adjacent to rib 32. Obviously, this operation can be performed on-site or at the factory where screw holes may be pre-drilled or pre-punched. However, even if holes are factory pre-drilled with relatively close spacing, an installer in the field must be able to drill screw holes precisely at ceiling joists or wall studs in order to safely secure the track. Since it is virtually impossible to start a drill on an angle, rib 32 or an equivalent drill stop means is a required element for proper installation.

Figure 6:
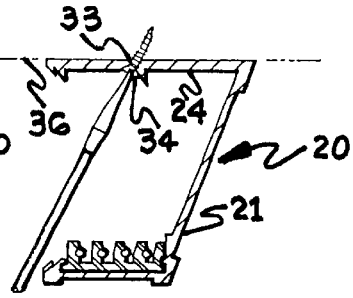
FIG. 6 is a transverse cross-sectional view of a track according to the present invention being installed on a ceiling or wall surface.

In FIG. 6 track 20 is shown with screw 34 securing leg 24 of track 20 through screw hole 33 to ceiling 2.

Figure 7:
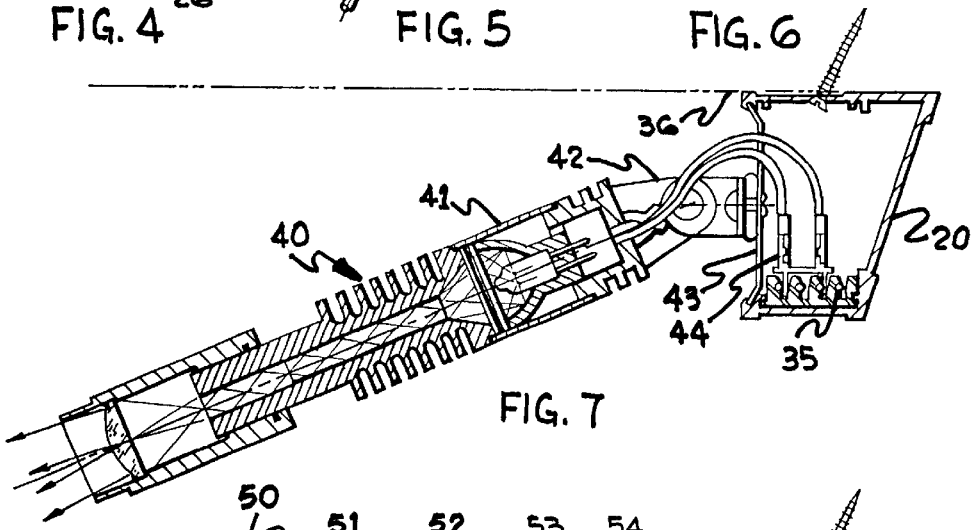
FIG. 7 is a transverse cross-sectional view of a track according to the present invention, including an external incandescent lighting fixture.

In FIG. 7 a transverse cross-sectional view of track 20 according to the present invention is shown installed on a ceiling 2 and supporting and connecting an incandescent tracklight fixture 40 comprising a luminaire 41 mounted to a trunnion 42 on a fixture adapter 43 and connected to track conductors 35 with a connector 44.

Figure 9:
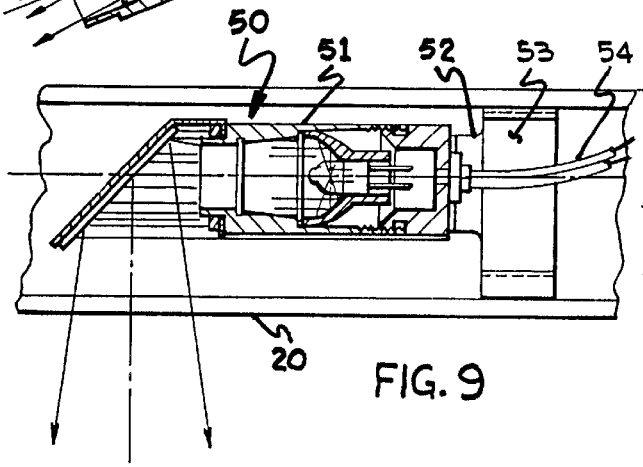
FIG. 9 is a side elevation partial cross-sectional view of the internal incandescent track fixture of FIG. 8.
Figure 8:
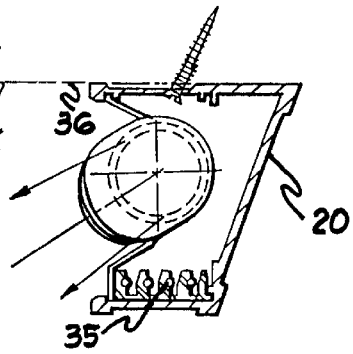
FIG. 8 is a transverse cross-sectional view of a ceiling-mounted track according to the invention, including an internal incandescent track fixture.

In FIGS. 8 and 9 track 20 according to the present invention is shown installed on a ceiling 2, supporting and connecting an incandescent spot tracklight fixture 50 comprising a luminaire 51 mounted to a trunnion 52 on a fixture adapter 53 and connected to track conductors 35 with a connector 54, not shown.

Figures 10, 11, 12, 13:
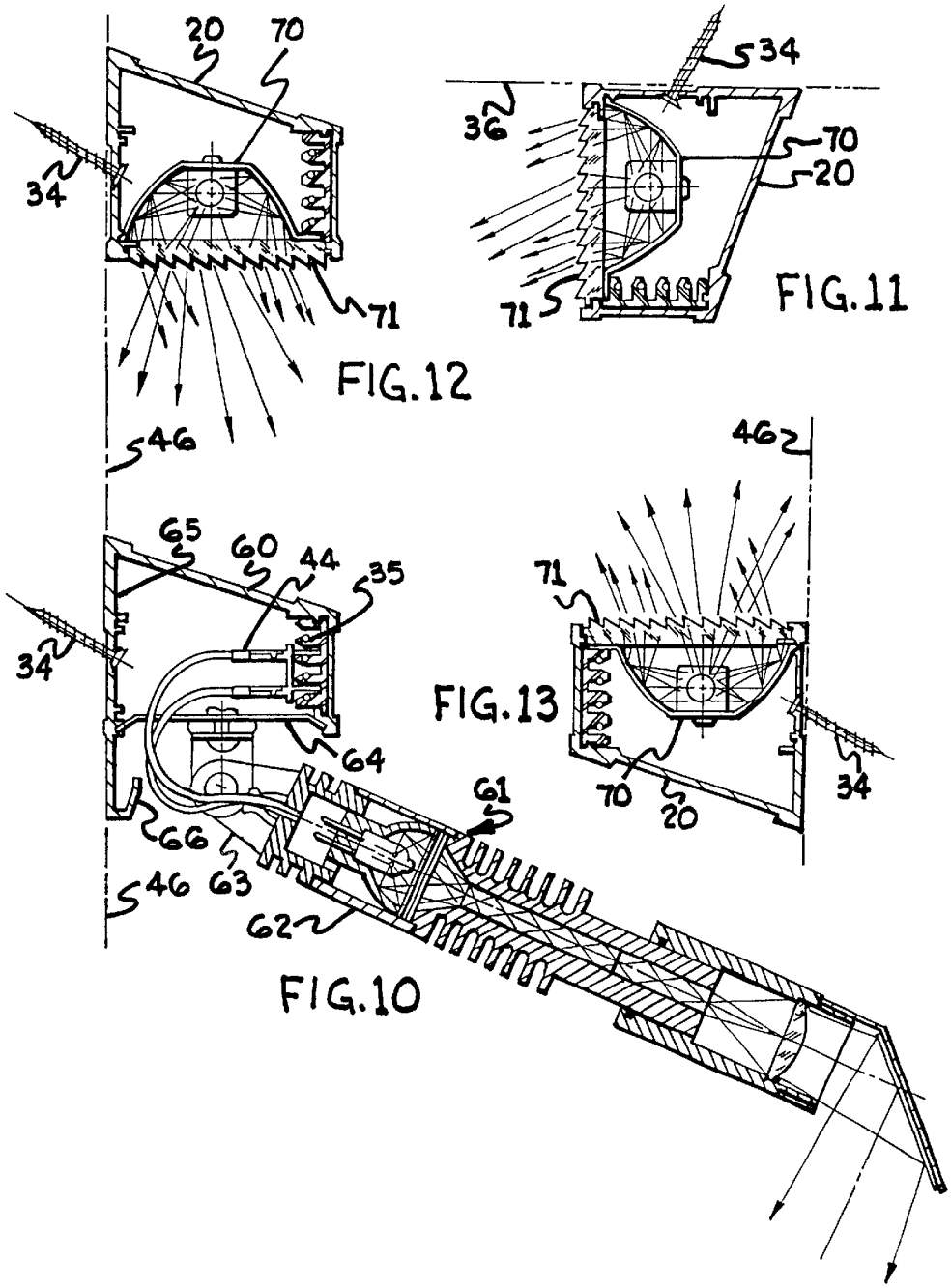
FIG. 10 is a transverse cross-sectional view of a track according to the invention, including an external wall-mounted incandescent track fixture used as a picture-hanger gallery light.
FIG. 11 is a transverse cross-sectional view of a track according to the invention including an internal fluorescent track fixture used as a ceiling-mounted wall-washer.
FIG. 12 is a transverse cross-sectional view of a track according to the invention, including an internal fluorescent track fixture used as a wall-mounted soffit downlight.
FIG. 13 is a transverse cross-sectional view of a track according to the invention, including an internal wall-mounted fluorescent track fixture used as a cove uplight.

In FIG. 10 a transverse cross-sectional view of a wall-mounted track 60 according to the present invention, is shown installed on a wall 3 and supporting and connecting an incandescent tracklight fixture 61 comprising a luminaire 62 mounted to a trunnion 63 on a fixture adapter 64 and connected to track conductors 35 with a connector 44. A preferred embodiment includes a J-shaped hook 66 for hanging artifacts such as paintings that may be illuminated by one or more tracklight fixtures 61 functioning as a picture-hanger gallery lights.

In FIG. 11 a transverse cross-sectional view of track 20 according to the present invention is shown installed on a ceiling 2 with screws 34 and supporting a fluorescent tracklight fixture 70 connected to track conductors 35 with a connector 44, as shown in FIG. 10. A linear-prism lens 71 is shown biasing lamp light off axis and away from the ceiling. The lens shown could be replaced with any of a number of commercially-available pyramidal prism lenses, Fresnel lenses, linear lenticular lenses or diffusing lenses. This embodiment thus functions as a ceiling-mounted wall-washer.

In FIG. 12 a transverse cross-sectional view of track 20 according to the present invention is shown installed on a wall 46 with screws 34 and supporting a fluorescent tracklight fixture 70 connected to track conductors 35 with a connector 44, as shown in FIG. 10. A linear-prism lens 71 is shown biasing lamp light off axis and away from the wall. This embodiment thus functions as a wall-mounted wall-washer soffit downlight.

In FIG. 13 a transverse cross-sectional view of track 20 according to the present invention is shown installed on a wall 46 with screws 34 and supporting a fluorescent tracklight fixture 70 connected to track conductors 35 with a connector 44, as shown in FIG. 10. This embodiment thus functions as a wall-mounted wall-washer cove uplight. A linear-prism lens 71 is shown biasing lamp light off axis and away from the wall.

OPERATION, RAMIFICATIONS AND SCOPE

In operation the present invention provides great versatility in luminaire selection in a variety of incandescent or fluorescent fixtures extending from the track profile or hidden within the track profile. Since the legs of the track are horizontal instead of vertical, luminaires do not extend downward into a room, reducing ceiling clutter, maintaining the visual height of the ceiling and keeping luminaires out of the reach of occupants. The advantages of the present invention of a track system include the ability to attach the track to a ceiling through one leg, whereby the open side of the U-shaped track is horizontal, not vertical. Thus the light may be aimed parallel to the ceiling, used as a wall washer, or may be used to illuminate objects on walls or on shelves on or near walls. The present invention track system is also attachable to a wall as a soffit downlight or a cove uplight.

It will be obvious to anyone skilled in the art that the embodiments and scope of the invention may be applied to other track cross-sectional shapes, providing that one leg of a U-shaped track has means for attaching the track to a wall or ceiling. It also will be obvious that the track attaching means may be employed to an intermediate structure spacing the track from the wall or ceiling, such as spacers or pendants, within the scope of the invention.

What is claimed is:

1. A tracklight system including:

a generally U-shaped track (20) comprising an elongated metal extrusion (21) having a canted base (22) extending between a first parallel leg (24) extending at an acute angle from the base (22) to a first distal end (27) and a second parallel leg (26) extending at an obtuse angle from the base (22) to a second distal end (29);

a drill guide on the first parallel leg for attaching the first parallel leg (24) to a wall or ceiling;

an elongated insulator (30) attached to the second parallel leg (26) and extending along a length of the track (20), the insulator having a number of longitudinal slots (31), each said slot including one or more electrical conductors (35) receiving power from a remote power source.

2. A tracklight system according to claim 1 in which the drill guide for attaching first parallel leg (24) to a wall or ceiling is an inward-facing rib (32) disposed on first parallel leg (24), between the canted base (22) and the first distal end (27), said rib (32) having a height to prevent a drill bit from sliding towards the canted base (22) of the extrusion (21) to drill screw holes (33).

3. A tracklight system according to claim 1 in which the drill guide (32) for attaching first parallel leg (24) to a wall or ceiling is a plurality of longitudinally-spaced holes (33).

4. A tracklight system according to claim 1 in which the distal end (27) of the first parallel leg (24) terminated in a J-shaped hook (66).

* * * * *